US005860853A

United States Patent [19]

Hasegawa et al.

[11] Patent Number: 5,860,853

[45] Date of Patent: Jan. 19, 1999

[54] APPARATUS FOR POLISHING WAFERS

[75] Inventors: Fumihiko Hasegawa; Makoto Kobayashi; Fumio Suzuki, all of Fukushima-ken, Japan

[73] Assignee: Shin-Etsu Handotai Co., Ltd., Tokyo, Japan

[21] Appl. No.: 769,441

[22] Filed: Dec. 19, 1996

[30] Foreign Application Priority Data

Dec. 28, 1995 [JP] Japan ..... 7-353987

[51] Int. Cl.[6] ..... B24B 7/22; B24B 37/04

[52] U.S. Cl. ..... 451/285; 451/41; 451/287

[58] Field of Search ..... 451/41, 285, 287, 451/288, 286

[56] References Cited

U.S. PATENT DOCUMENTS

| | | | |
|---|---|---|---|
| 3,841,031 | 10/1974 | Walsh . | |
| 4,258,508 | 3/1981 | Wilson et al. | 451/41 |
| 4,918,870 | 4/1990 | Torbert et al. | 451/287 |
| 5,333,413 | 8/1994 | Hashimoto | 451/287 |
| 5,361,545 | 11/1994 | Nakamura | 451/287 |
| 5,584,751 | 12/1996 | Nakazuma et al. | 451/41 |
| 5,647,789 | 7/1997 | Kitta et al. | 451/288 |

FOREIGN PATENT DOCUMENTS

| | | |
|---|---|---|
| 0578351 | 1/1994 | European Pat. Off. . |
| 2521895 | 8/1983 | France . |
| 7-201787 | 8/1995 | Japan . |
| 2297426 | 7/1996 | United Kingdom . |

*Primary Examiner*—Eileen P. Morgan
*Attorney, Agent, or Firm*—Oliff & Berridge, PLC

[57] ABSTRACT

An apparatus for polishing wafers comprising a turn table with a polishing pad fixedly extended thereon, at least one polishing head positioned above a point on the turn table spaced by a distance from its center, a plate mounted on a lower surface of the at least one polishing head, and a carrier, which is used for retaining the wafers, mounted on the plate in a manner such that the carrier is freely rotatable relative to the plate, wherein a backing pad which is used to press the wafers is fixed on the plate and the wafers are rotated around their respective centers, while being revolved around the center of the plate. According to the apparatus, polished wafers with an excellent flatness are obtained in a reliable manner.

12 Claims, 3 Drawing Sheets

APPARATUS FOR POLISHING WAFERS

TECHNICAL BACKGROUND

The present invention relates to an apparatus for polishing silicon semiconductor wafers and compound semiconductor wafers (hereinafter both are referred to as wafers).

BACKGROUND ART

Heretofore, the so-called mechano-chemical polishing method has been adopted as a method for polishing wafers, wherein chemical polishing by an alkali and mechanical polishing by silica are combined in the presence of a polishing agent prepared by dispersing colloidal silica in an alkaline aqueous solution on a proper polishing pad. Generally, in the mechano-chemical polishing method, the so-called wax process has been adopted, wherein wafers are fixed on a plate with the help of wax. However, the wax process has requirements that a lower surface of the plate should be flat and a wax film to fix each wafer on the lower surface should be uniform in thickness and moreover, a problem that when the wafers W are fixed by the wax process and polished in a situation where a foreign matter lies between a wafer W and the lower surface of the plate 30, as shown in FIG. 3(*a*), a dimple 33 is formed on a polished surface of the wafer W after it is separated from the plate 30, since a front surface of the wafer W is locally deformed by being strongly pressed from the back surface at the position of the foreign matter toward a polishing pad 32 as shown in FIG. 3 (*b*) due to hardness of the plate 30 and thereby the deformed part of the front surface is locally polished off more than the other as shown in FIG. 3(*c*). Therefore, the wafers W and the plate 30 both have to be subjected to a close control over particle contamination of the surfaces before the wax process.

In view of the above requirements and problem of the wax process, the so-called wax-free process is now adopted, wherein wafers are held on a plate without wax. In the wax-free process, a backing pad made of a special film having a good adhesiveness to a wafer is used for holding the wafer. Moreover, the wax-free process uses a carrier for retaining each wafer at a position and the carrier and wafers are static relative to a plate. Effects of the wax-free process are described referring to FIG. 4. Even when a foreign matter 31 enters the gap between a backing pad 34 and a wafer W in the wax-free process as shown in FIG. 4 (*a*), the front surface of the wafer W is not selectively polished off more at the position of the foreign matter than the other as shown in FIG. 4 (*c*), since the backing pad 34 which presses the wafer W toward a polishing pad is soft, thereby deformed as shown in FIG. 4(*b*) and consequently the front surface of the wafer W is not strongly pressed to the polishing pad at the position of the foreign matter.

Other than the above mentioned problem, the wax process has another problem that in addition of the necessity of wax, a cleaning process in the last stage is very burdensome, since, after a polishing process, the wafers and the plate have to be cleaned with caustic soda to remove residual wax, then rinsed in water and finally dried with the help of isopropyl alcohol. In contrast, the wax-free process has advantages that a cost reduction is realized by a reduction due to non-use of wax and the cleaning process in the last stage is conducted only by brush-cleaning in the presence of hot water.

The wax-free process has strong points as compared with the wax process as above mentioned. However, the wax-free process has an inherent fault that the backing pad has difficulty in obtaining a flatness of the surface due to its softness and the flatness of a polished wafer becomes poor due to the poor flatness of the backing pad.

As a method to solve this fault, it can be contrived that a wafer is rotated around its center while retaining the position of the center relative to a backing pad during a polishing process by applying a surfactant on the backing pad. According to this method, the flatness of a polished wafer is improved, as compared with the case of non-rotation of the wafer, since the greater part of the surface of the backing pad is contacted by the wafer due to rotation.

Even with the wax-free method using a surfactant applied on a surface of a backing pad, there still remain problems against acquiring polished wafers with an excellent flatness in a reliable manner, the problems being that the portion of a backing pad facing the periphery of a wafer is subjected to local degradation in quality by a rotation of the wafer, since the wafer is rotated in the same place and secondly, degrees of degradation of backing pads are different between portions in the neighborhoods of the outer periphery of a plate and its center.

SUMMARY OF THE INVENTION

The present invention has been made in view of the above mentioned circumstances. Accordingly, the present invention has an object to provide an apparatus for polishing wafers with which polished wafers with an excellent flatness can be obtained in a reliable manner.

A first aspect of the present invention is directed to an apparatus for polishing wafers, which comprises a turn table with a polishing pad fixedly extended thereon, at least one polishing head positioned above a point on the turn table spaced by a distance from its center, a plate mounted on a lower surface of the at least one polishing head, and a carrier, which is used for retaining the wafers, mounted on the plate in a manner such that the carrier is freely rotatable relative to the plate, wherein a backing pad which is used to press the wafers is fixed on the plate and the wafers are rotated around their respective centers, while being revolved around the center of the plate.

A second aspect of the present invention is directed to an apparatus for polishing wafers as defined in the first aspect of the present invention, wherein a surfactant is applied on a lower surface of the backing pad.

According to the above mentioned means, degradation of a packing pad progresses gradually and globally, since the wafers are polished by being rotated around their centers, while being revolved around the center of the plate and consequently almost all the surface of the backing pad is utilized. That is to say, uneven degradation of the backing pad has a small chance to occur and thereby polished wafers with an excellent flatness are obtained in a reliable manner.

BRIEF DESCRIPTION OF THE DRAWINGS

Many other features, advantages and additional objects of the present invention will become manifest to those versed in the art upon making reference to the detailed description which follows and the accompanying sheet of drawings.

DETAILED DESCRIPTION OF THE INVENTION

Figure 1:
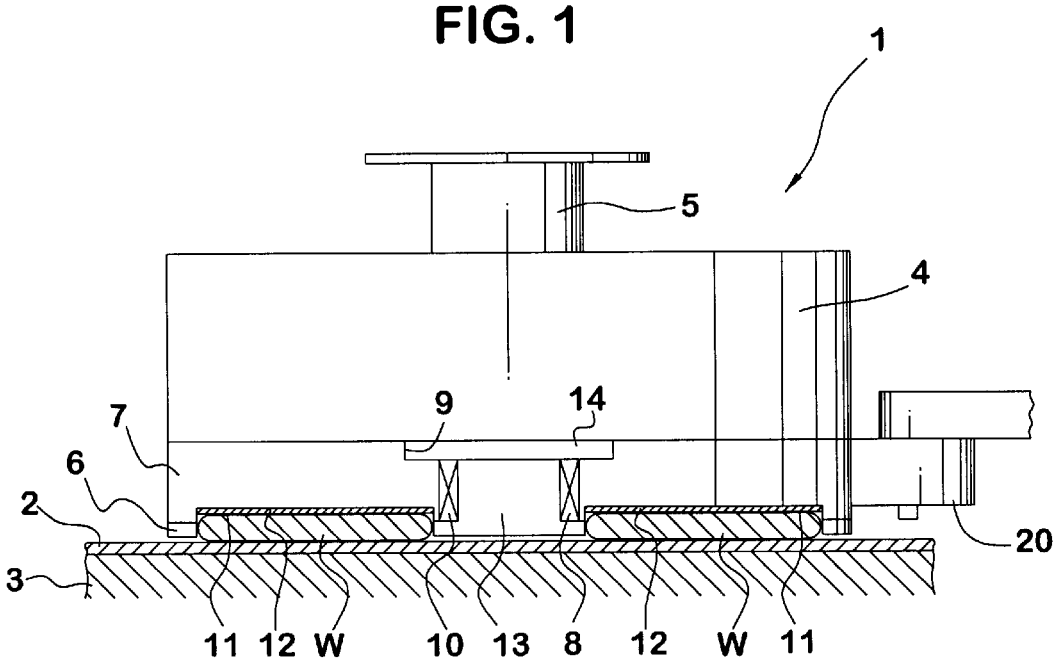
FIG. 1 is an elevational view in section of a main part of an apparatus for polishing wafers embodying the present invention.
Figure 2:
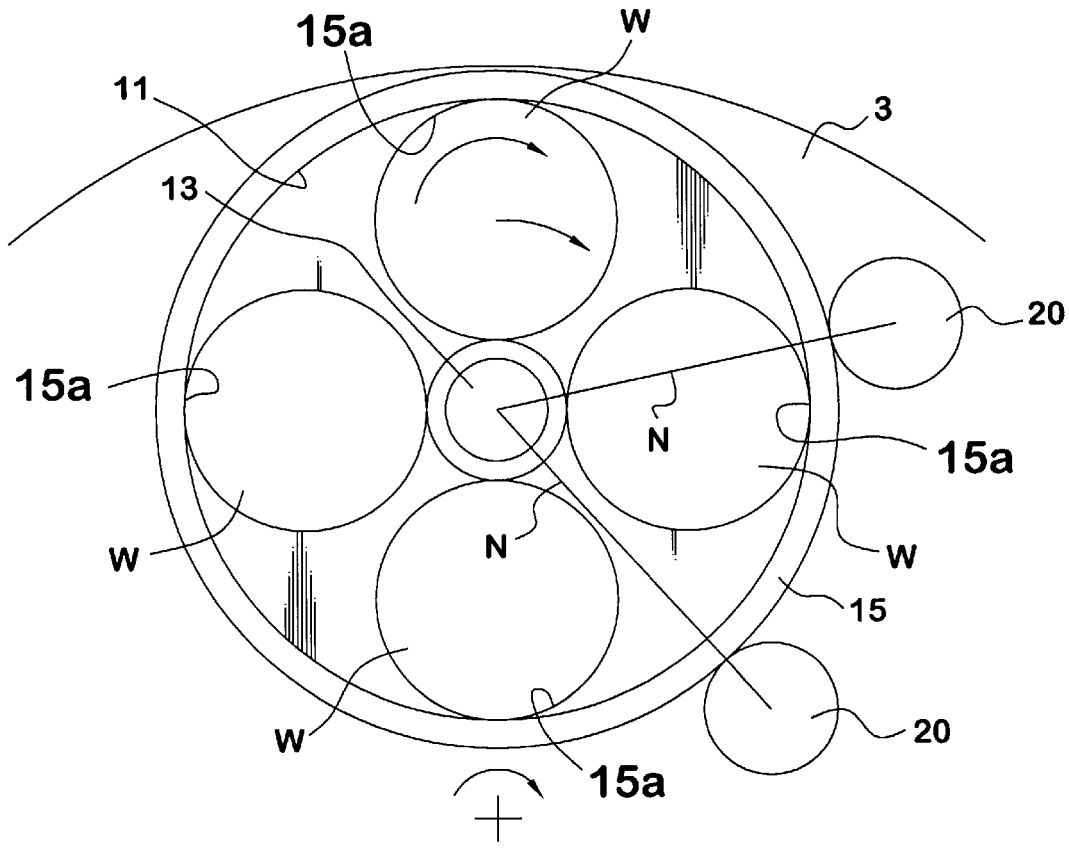
FIG. 2 is a plan view of a main part of an apparatus for polishing wafers embodying the present invention.
Figure 3A:
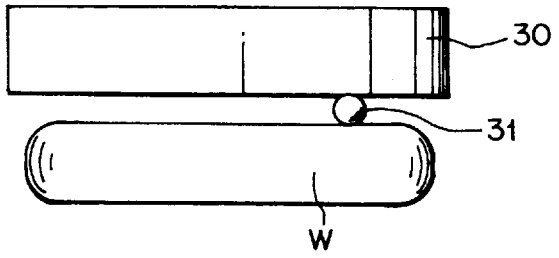
FIG. 3(a) (RELATED ART)
FIGS. 3(*a*) to 3(*c*) are diagrammatic views illustrating how a wafer is polished in the course of a conventional wax process of polishing.
Figure 3B:
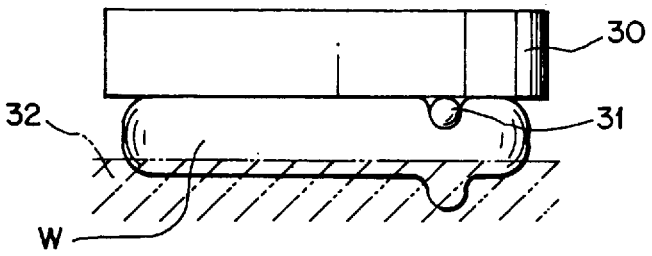
FIG. 3(b) (RELATED ART)
Figure 3C:
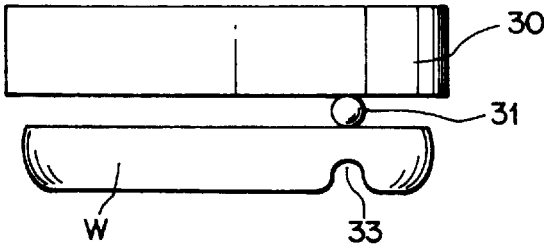
FIG. 3(c) (RELATED ART)
Figure 4A:
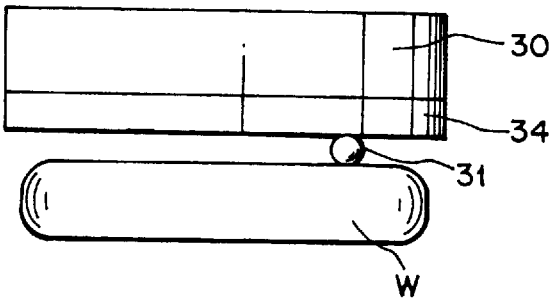
FIG. 4(a) (RELATED ART)
FIGS. 4(*a*) to 4(*c*) are diagrammatic views illustrating how a wafer is polished in the course of a conventional wax-free process of polishing.
Figure 4B:
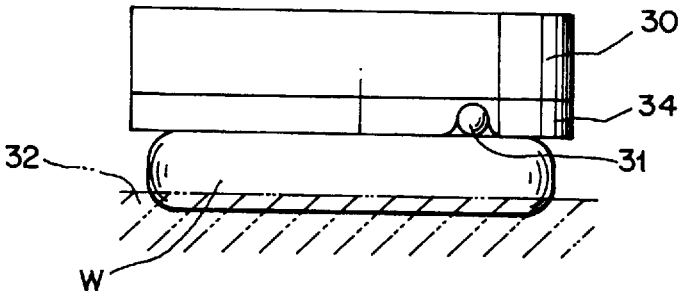
FIG. 4(b) (RELATED ART)
Figure 4C:
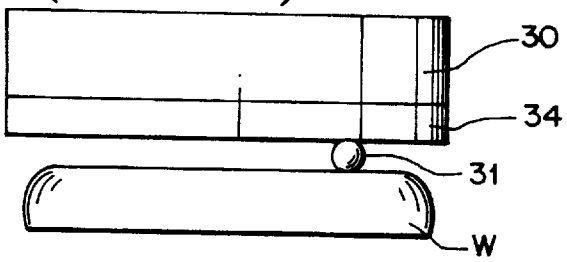
FIG. 4(c) (RELATED ART)

In FIG. 1, an apparatus 1 for polishing wafers embodying the present invention is shown. The apparatus comprises a turn table 3 across the surface of which a polishing pad 2 is fixedly extended, at least one polishing head 4 positioned above a point on the turn table 3 spaced by a distance from the center and a nozzle for supplying water or polishing agent (not shown).

The turn table 3 is rotated by an electric motor (not shown). The polishing pad 2, which is fixedly extended on the turn table 3, is made of hard urethane foam and has a high retainability of abrasive grains and thereby a high polishing power, the polishing pad having pores at a high density, each of which has a small diameter.

The at least one polishing head 4 is shiftable upward or downward by moving a shaft 5 with the help of a device for vertical shift inclusive of an air cylinder, an oil cylinder or a rack-and-pinion mechanism (not shown). The plate 7 is mounted on the lower surface of the at least one polishing head 4 and the carrier 6 is mounted to the plate 7. The plate 7 has a through hole 8 in the middle portion coaxially with the axis and the through hole 8 is, at its top, communicated with a circular recess 9 larger in diameter than the through hole 8. A bearing 10 is mounted in the through hole 8. A shallow flat groove 11 in the shape of a doughnut is formed in the lower surface of the plate 7, wherein the width of the groove 11 is designed a little larger than the diameter of any of wafers W in order to permit a smooth revolution of the wafers around the center of the plate 7. A backing pad 12 is fixedly extended on the flat bottom of the groove 11. A backing pad 12 is made of soft urethane foam and has a long useful life, since the soft urethane foam has pores each having a small diameter and is high in hardness. In addition, a surfactant is applied on the backing pad 12 to reduce a frictional coefficient of the backing pad 12 to a lower value than that of the polishing pad 2. As a surfactant, for example, an anion surfactant such as alkylbenzene sulfonic acid is used. When this surfactant is adopted, a cleaning process becomes very easy, since the surfactant gives the backing pad a wettability, penetrability and itself works as an emulsifier for attached foreign matters. In the case where the frictional coefficient of the backing pad 12 is smaller than that of the polishing pad 2, no surfactant is required. In the apparatus 1 for polishing wafers in this embodiment, the groove 11 in the shape of a doughnut is formed in the lower surface of the plate 7 as above mentioned, but the groove 11 is not necessarily required, since wafers are not displaced from the original position in a carrier 6. The backing pad 12 may be fixedly extended either in a particular annular area along which the wafers W travel or all over the lower surface of the plate 7.

The carrier 6 has a shaft 13 and the shaft 13 is inserted into the through hole 8 and the carrier 6 is rotatable relative to the plate 7 with the help of the bearing 10. A circular disk 14 which is to be rested in the circular recess 9 is fixedly mounted on the shaft 13 by bolts, adhesive, welding or the like and the carrier 6 is prevented from falling down from the plate 7 with the help of the circular disk 14. When the circular disk 14 is fixed by bolts, the carrier 6 can be separated from the plate 7 with ease, exchange between new and old backing pads 12 fixedly extended on the lower surface of the plate 7 becomes easy and since the carrier 6 can be independently handled, cleaning of the carriers 6 becomes easy. The plate-like body 15 of the carrier 6 has a circular shape and the diameter of the plate-like body 15 is the same as that of the plate 7. A plurality of holes 15*a*, for example four holes 15*a* in this embodiment, are formed in a limited area of the carrier 6 which area corresponds in size and position with the groove 11. The diameter of each of the holes 15*a* is a little larger than that of each of the wafers W so as the insertion of facilitate to insert the wafers W in the respective holes 15*a*. In this embodiment, the carrier 6 is freely rotated, but it may be forcibly rotated. In the case of a forced rotation, functions of the apparatus are increased in reliability, but a structure of the apparatus becomes adversely complex. In this embodiment, the free rotation is chosen due to simplicity of the structure, but the forced rotation which comprises a means for forcibly rotating the carrier may be adopted, if complexity of the structure is not burdensome. In this embodiment, two guide rollers 20 are further equipped with in such away that the rollers contact the outer periphery of the plate 7 all the time in a polishing process and normals N to the tangents at the positions of contact intersect the central axis of the shaft 5 for the purpose that the center of the plate 7 always aligns with the center of the at least one polishing head 4. An apparatus for polishing wafers W with a plurality of polishing heads according to the present invention has an increased productivity as compared with the apparatus with one polishing head.

Now, a method for polishing wafers W using the apparatus 1 for polishing wafers will be described below.

Wafers W are first rinsed by water and then they are subjected to formation of $SiO_2$ film on their surfaces. The oxidized wafers W are cleaned in an aqueous solution of hydrogen peroxide mixed with ammonia in order to make the surface of each of the oxidized wafers W hydrophilic. In this embodiment, the close control over particle contamination as in the case of the wax process is not required. The hydrophilic wafers W are mounted on the plate 7 on which the carrier 6 has been mounted, wherein the wafers W are inserted into the holes 15a formed in the carrier 6. The plate 7 on which the wafers W have been mounted is placed at a position under the at least one polishing head 4 in a manner such that the wafers W contact with the polishing pad 2 on the turn table 3. Through the above operations, the at least one polishing head 4 is maintained at a position upward by moving up the shaft 5 with the help of a device for vertical shifting (not shown). The at least one polishing head 4 is then shifted down on the plate 7 by moving down the shaft 5 with the help of the device for vertical shifting (not shown). After the at least one polishing head 4 is rested on the plate 7, the turn table is rotated by an electric motor (not shown), when the carrier 6 is rotated around its rotational axis at a predetermined position by frictional forces acting on the wafers in the same direction as the rotational direction (in other words, the moving direction of an eccentric point on the surface) of the turn table 3. Such a rotation as this is caused by a difference in linear velocity given by the rotation of the turn table 3 between wafers W in a peripheral portion and a central portion and when the carrier 6 is rotated, the wafers W are rotated around their respective centers, while they are revolving around the center of the plate 7.

In such conditions, local degradation of the backing pad is decreased in degree and adverse influence of poor flatness of the backing pad 12 is minimized, since polishing of the wafers are conducted using the greater part of the backing pad 12. In concrete terms, an average useful life of the backing pad 12 is greatly improved according to the present invention. Besides, removal of residual wax by caustic soda is not required as in the case of the wax process.

One embodiment of the apparatus for polishing wafers according to the present invention is, as main part, described above, but it should be expressly understood that the present invention is not restricted to the content of the above description and can be further modified in embodiment in various ways within the concept.

The apparatus for polishing wafers according to the present invention comprises a turn table with a polishing pad fixedly extended thereon, at least one polishing head positioned above a point on the turn table spaced by a distance from its center, a plate mounted on a lower surface of the at least one polishing head, and a carrier, which is used for retaining the wafers, mounted on the plate in a manner such that the carrier is freely rotatable relative to the plate, wherein a backing pad is fixed on a lower surface of the plate and the wafers are rotated around their respective centers, while being revolved around the center of the plate. In such a structure, the wafers can be polished in conditions that they are rotated around their respective centers, while being revolved around the center of the plate and therefore almost all the surface of the backing pad is utilized, so that degradation of the backing pad progresses gradually and globally. In other words, degradation does not occur locally on the surface. In such conditions, polished wafers with an excellent flatness can be obtained in a reliable manner.

What is claimed is:

1. An apparatus for polishing wafers, comprising:

a) a turn table including a polishing pad fixedly extended thereon and a center;

b) at least one polishing head, each polishing head being positioned above a point on the turn table spaced from the center and each polishing head having a lower surface;

c) a plate mounted on the lower surface of each polishing head, each plate having a lower surface and a center;

d) a resilient backing pad fixed on the lower surface of each plate for pressing the wafers; and e) a carrier mounted on each plate for retaining the wafers, each carrier being freely rotatable relative to the plate, and the wafers rotating about their respective centers on the backing pad while being revolved around the center of the plate.

2. An apparatus for polishing wafers as claimed in claim 1, wherein the backing pad includes a lower surface, and further comprising a surfactant applied on the lower surface of the backing pad.

3. An apparatus for polishing wafers as claimed in claim 1, comprising a plurality of polishing heads.

4. An apparatus for polishing wafers as claimed in claim 1, wherein the backing pad is comprised of urethane foam.

5. An apparatus for polishing wafers, comprising:

a) a turn table including a polishing pad thereon and a center;

b) a plurality of polishing heads, each polishing head being positioned above a point on the turn table spaced from the center and each polishing head having a lower surface;

c) a plate mounted on the lower surface of each polishing head, the plate having a lower surface and a center;

d) a resilient backing pad fixed on the lower surface of each plate for pressing the wafers;

e) a surfactant applied on a lower surface of each backing pad; and f) a carrier mounted on each plate for retaining the wafers, each carrier being freely rotatable relative to the plate, and the wafers rotating about their respective centers on the backing pad while being revolved relative to the plate.

6. An apparatus for polishing wafers, comprising:

a) a turn table including a polishing pad thereon and a center;

b) at least one polishing head, each polishing head being positioned above a point on the turn table spaced from the center, and each polishing head having a lower surface;

c) a plate mounted on the lower surface of each polishing head, each plate having a lower surface and a center;

d) a resilient backing pad fixed on the lower surface of each plate for pressing the wafers, each backing pad being doughnut shaped; and e) a carrier mounted on each plate for retaining the wafers, each carrier being rotatable relative to the plate, and the wafers rotating around their respective centers on the backing pad while being revolved relative to the center of the plate.

7. An apparatus for polishing wafers as claimed in claim 6, wherein the backing pad includes a lower surface, and further comprising a surfactant applied on the lower surface of the backing pad.

8. An apparatus for polishing wafers as claimed in claim 6, comprising a plurality of polishing heads.

9. An apparatus for polishing wafers as claimed in claim 6, wherein the backing pad is comprised of urethane foam.

10. An apparatus for polishing wafers as claimed in claim 6, further comprising guide rollers for forcibly rotating the carriers.

11. The apparatus for polishing wafers as claimed in claim 6, wherein the carriers are freely rotatable relative to the plate.

12. An apparatus for polishing a plurality of wafers, comprising:

a) a turn table including a polishing pad fixedly extended thereon and a center;

b) at least one polishing head, each polishing head being positioned above a point on the turn table spaced from the center and each polishing head having a lower surface;

c) a plate mounted on the lower surface of each polishing head, each plate having a lower surface and a center;

d) a resilient backing pad fixed on the lower surface of each plate for pressing the wafers; and e) a carrier mounted on each plate, each carrier including a plurality of holes, each for retaining a wafer, each carrier being rotatable relative to the plate, and the wafers rotating about their respective centers on the backing pad while being revolved around the center of the plate.

* * * * *